US008602256B2

(12) United States Patent
Wang

(10) Patent No.: US 8,602,256 B2
(45) Date of Patent: Dec. 10, 2013

(54) QUICK OPEN STRUCTURE FOR A TOOL BOX

(76) Inventor: Yao-Hung Wang, Taichung (TW)

( * ) Notice: Subject to any disclaimer, the term of this patent is extended or adjusted under 35 U.S.C. 154(b) by 149 days.

(21) Appl. No.: 13/072,806

(22) Filed: Mar. 28, 2011

(65) Prior Publication Data

US 2012/0248131 A1 Oct. 4, 2012

(51) Int. Cl.
*B65D 45/16* (2006.01)
*B65D 45/20* (2006.01)

(52) U.S. Cl.
USPC ..... 220/833; 220/326; 70/70; 292/10; 292/109

(58) Field of Classification Search
USPC ..... 220/833, 326, 324, 281; 70/70; 292/10, 292/71, 81, 109, 122, 163, 179, 129
See application file for complete search history.

(56) References Cited

U.S. PATENT DOCUMENTS 4,331,257 A * 5/1982 Taschner ..... 220/324
4,974,740 A * 12/1990 Niles et al. ..... 220/324
5,135,126 A * 8/1992 Petit ..... 220/326
5,706,968 A * 1/1998 Riley ..... 220/326
6,082,539 A * 7/2000 Lee ..... 206/373
6,328,355 B1 * 12/2001 Bortz ..... 292/307 R
6,334,560 B1 * 1/2002 Lentini ..... 224/404
6,371,326 B1 * 4/2002 Gabele et al. ..... 220/326
6,789,692 B2 * 9/2004 Prezelin ..... 220/324
2010/0012538 A1 * 1/2010 Brunner ..... 206/373
2010/0083714 A1 * 4/2010 Keighley et al. ..... 70/89

* cited by examiner

*Primary Examiner* — Mickey Yu
*Assistant Examiner* — Niki Eloshway

(57) ABSTRACT

A quick open structure for a tool box contains a body including an upper housing, a lower housing, two retaining portions, and two bearing portions; the lower and the lower housings including a first and a second chambers individually, and the first chamber including two grooves respectively and a limiting element extending therefrom, each groove including an opening, the second chamber including a receiving member; wherein the first chamber is provided to receive a locking device and includes a pressing member and an engaging member, the pressing member includes a larger-area press portion and two side straps in response to the grooves, each side strap includes a hole to receive a returning spring, and a first and a second axial rotating portions include a first orifice and a second orifice to insert two shafts respectively, each shaft includes a resilient element, the engaging member includes a fastening block.

5 Claims, 13 Drawing Sheets

QUICK OPEN STRUCTURE FOR A TOOL BOX

BACKGROUND OF THE INVENTION

1. Field of the Invention

The present invention relates to a tool box, and more particularly to a quick open structure for a tool box that is capable of being opened, closed, and removed quickly.

2. Description of the Prior Art

A conventional tool box includes an upper housing and a lower housing to be connected together, and an axial rotating portion disposed on a bottom end thereof to open and close the tool box, the tool box also includes a locking device fixed on an upper end thereof, and the locking device includes a retaining member secured on an upper housing thereof and an engaging block arranged on the lower housing thereof such that when the upper housing and the lower housing are covered together, the retaining member and the engaging block engage with each other so that the tool box is closed; as desiring to opening the tool box, the retaining member is operated to disengage from the engaging block so that the upper housing disengages from the lower housing.

However, such a conventional tool box still has the following defects:

1. The retaining member is operated manually to disengage from the engaging block, but when desiring to connect the upper and the lower housing together, a contacting area of the retaining member and the engaging block has to be formed larger, accordingly the user has to operate the tool box with more effort, causing energy consumption.

2. The locking device causes a fatigue after a long period of time, so that the upper and the lower housings can not engage with each other tightly.

The present invention has arisen to mitigate and/or obviate the afore-described disadvantages.

SUMMARY OF THE INVENTION

The primary object of the present invention is to provide a quick open structure for a tool box that is capable of being opened, closed, and removed quickly.

To obtain the above objective, a quick open structure for a tool box provided by the present invention contains:

a body including an upper housing and a lower housing. the body also including at least one retaining portion disposed on two sides of an upper end thereof and two bearing portions secured on two sides of a bottom end thereof:

the lower housing includes at least one first chamber defined on two sides thereof, and the lower housing includes at least one second chamber defined on two sides thereof, each of the at least One first chamber including two grooves secured on two sides thereof and a limiting element extending therefrom, and each groove including an opening arranged on a rear end thereof, each of the at least one second chamber of the lower housing including a receiving member formed thereon;

wherein each of the at least one first chamber of the upper housing is provided to receive a locking device which includes a pressing member and an engaging member, and the pressing member includes a larger-area press portion formed on a front end thereof and two side straps corresponding the two grooves, and each side strap includes a hole to receive a returning spring, and each of at least one first axial rotating portion of the body includes a first orifice, and each of at second axial rotating portion of the body includes a second orifice, such that a shaft is inserted into two first orifices and two second orifices so that the pressing member and the engaging member are connected together, and the shaft includes a resilient element fixed thereon to be biased against inner surfaces of the pressing member and the engaging member, the engaging member includes a fastening block arranged on an inner surface of a front end thereof.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
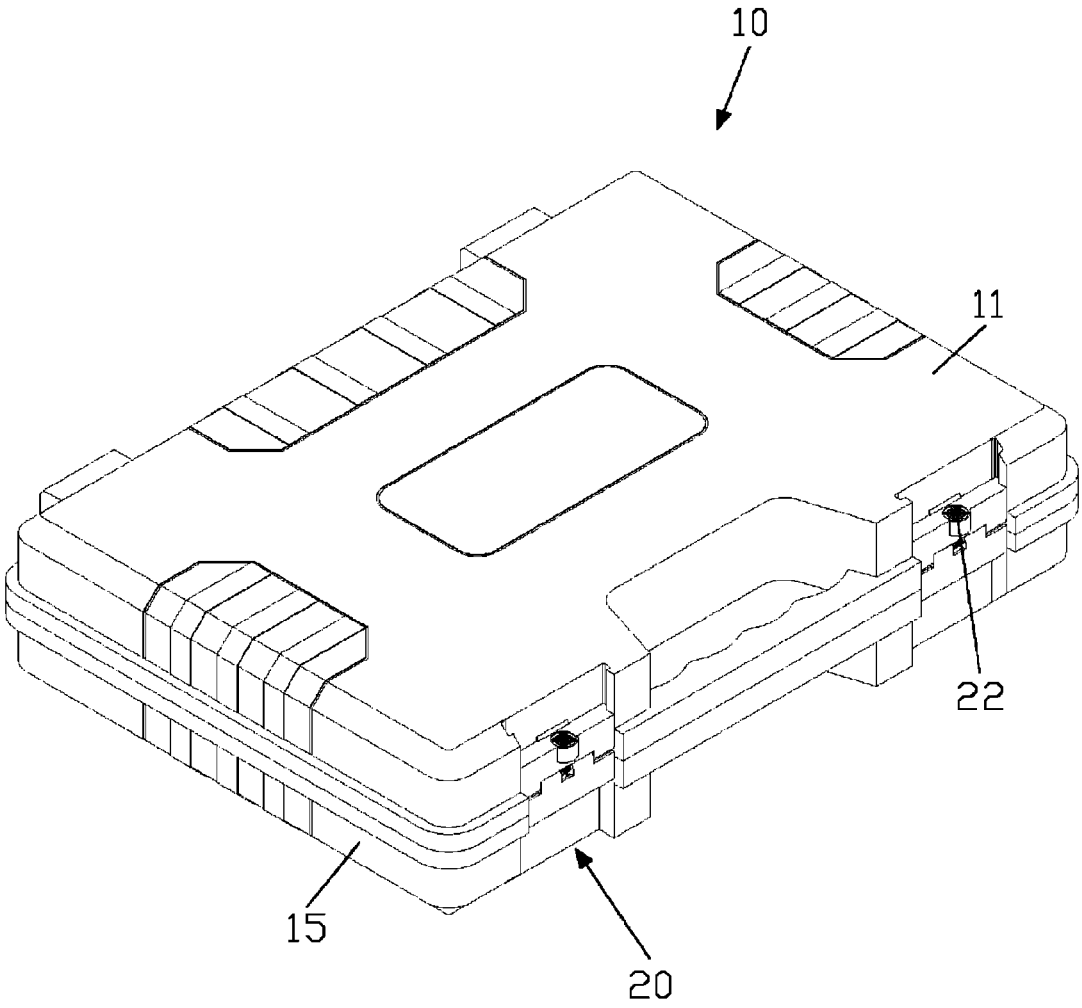
FIG. 1 is a perspective view of the assembly of a quick open structure for a tool box according to a preferred embodiment of the present invention.
Figure 2:
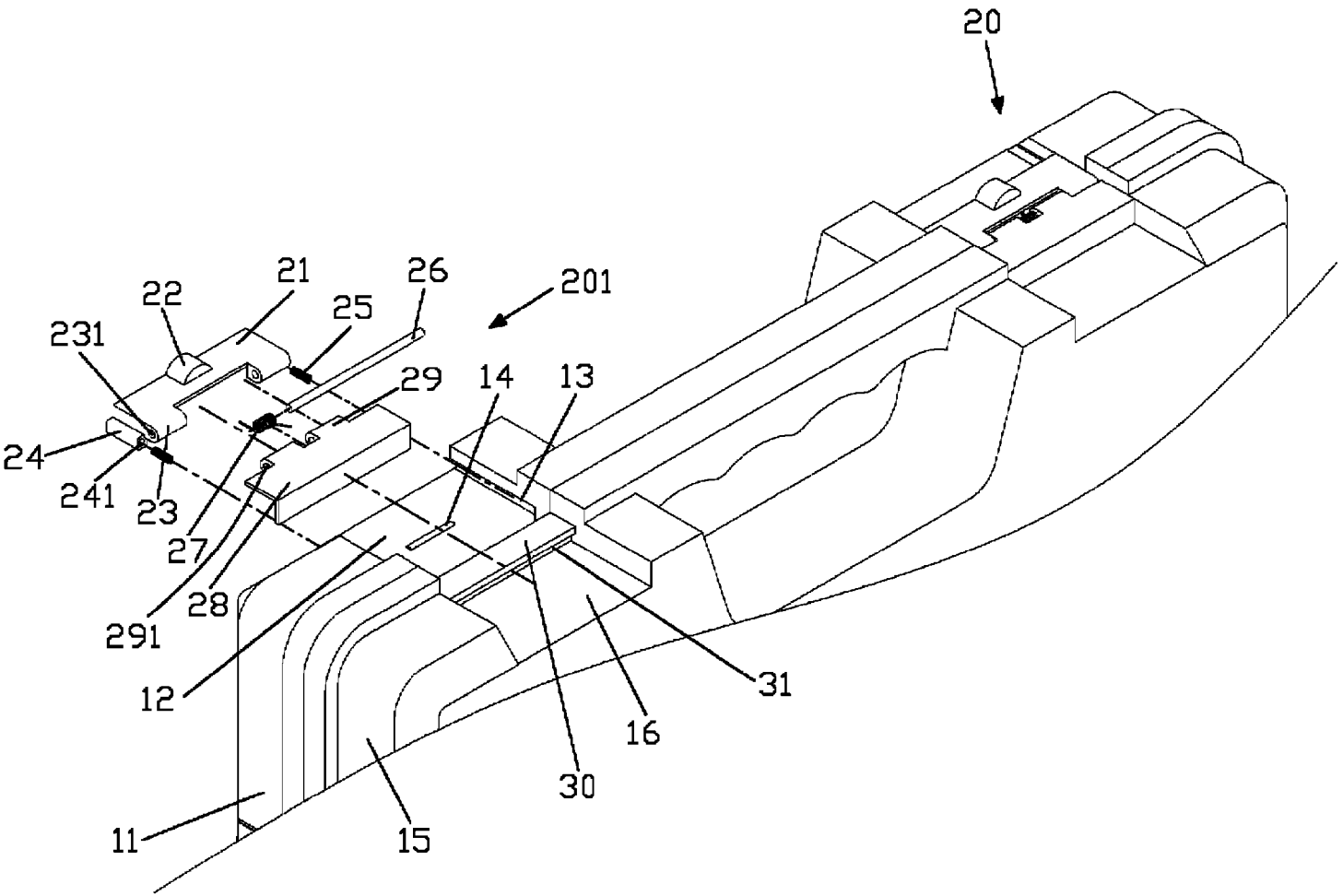
FIG. 2 is a perspective view of the exploded components of a locking device of the quick open structure for the tool box according to the preferred embodiment of the present invention.

Referring to FIGS. 1 and 2, a quick open structure for a tool box in accordance with a preferred embodiment of the present invention comprises a body 10 including an upper housing 11 and a lower housing 15. The body 10 also includes at least one retaining portions 20 disposed on two sides of an upper end thereof, the lower housing 11 includes at least one first chamber 12 defined on two sides thereof, and the lower housing 15 includes at least one second chamber 16 defined on two sides thereof. Each of the at least one first chamber 12 includes two grooves 13 secured on two sides thereof and a limiting element 14 extending outwardly therefrom. Each of the at least one second chamber 16 includes a receiving member 30 formed thereon. Each of at least one first chamber 12 of the upper housing 11 is provided to receive a locking device 201 which includes a pressing member 21 and an engaging member 28, and the pressing member 21 includes a larger-area press portion 22 formed on a front end thereof and two side straps 24 corresponding to the two grooves 13, and each side strap 24 includes a hole 241 to receive a returning spring 25, and each of at least one first axial rotating portion 23 of the body 10 includes a first orifice 231, and each of at least one second axial rotating portion 29 includes a second orifice 291, such that a shaft 26 is inserted into two first orifices 231 and two second orifices 290 so that the pressing member 21 and the engaging member 28 are connected together, and the shaft 26 includes a resilient element 27 fixed thereon.

Figure 3:
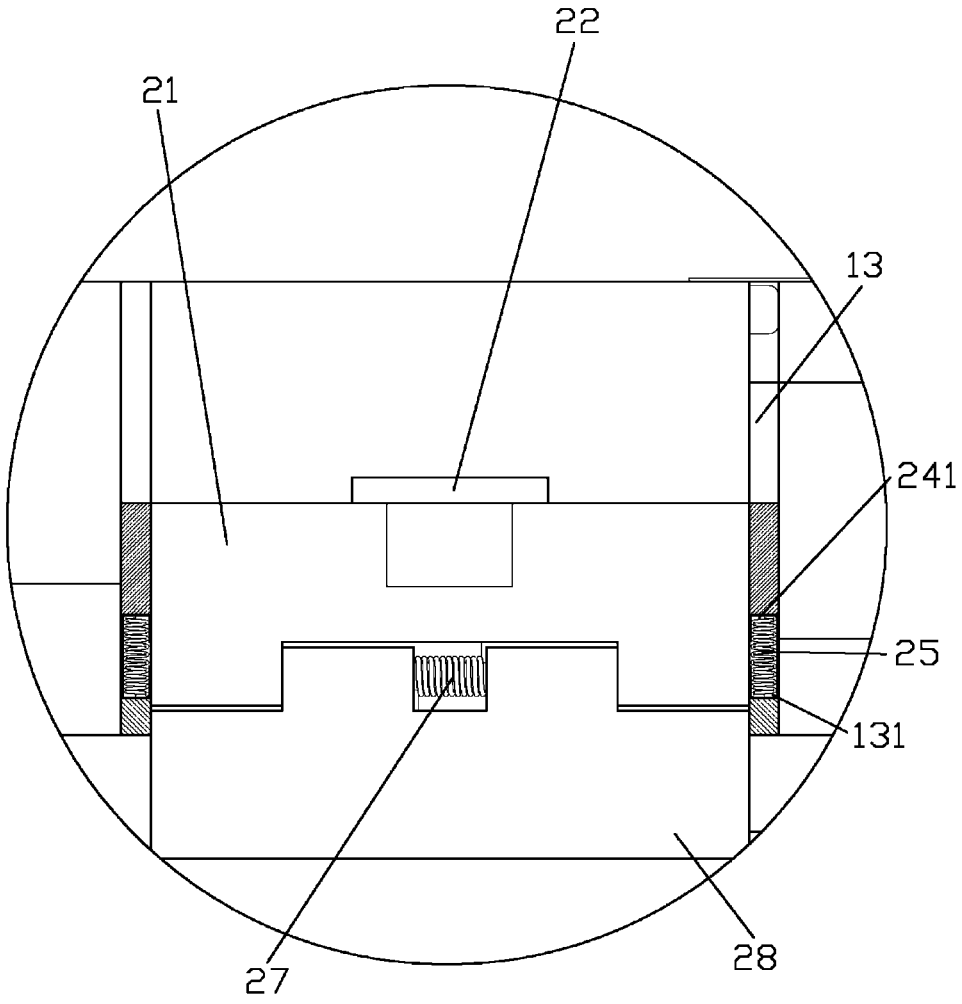
FIG. 3 is a partial cross sectional view of the assembly of an upper housing and a pressing member of the quick open structure for the tool box according to the preferred embodiment of the present invention.
Figure 4:
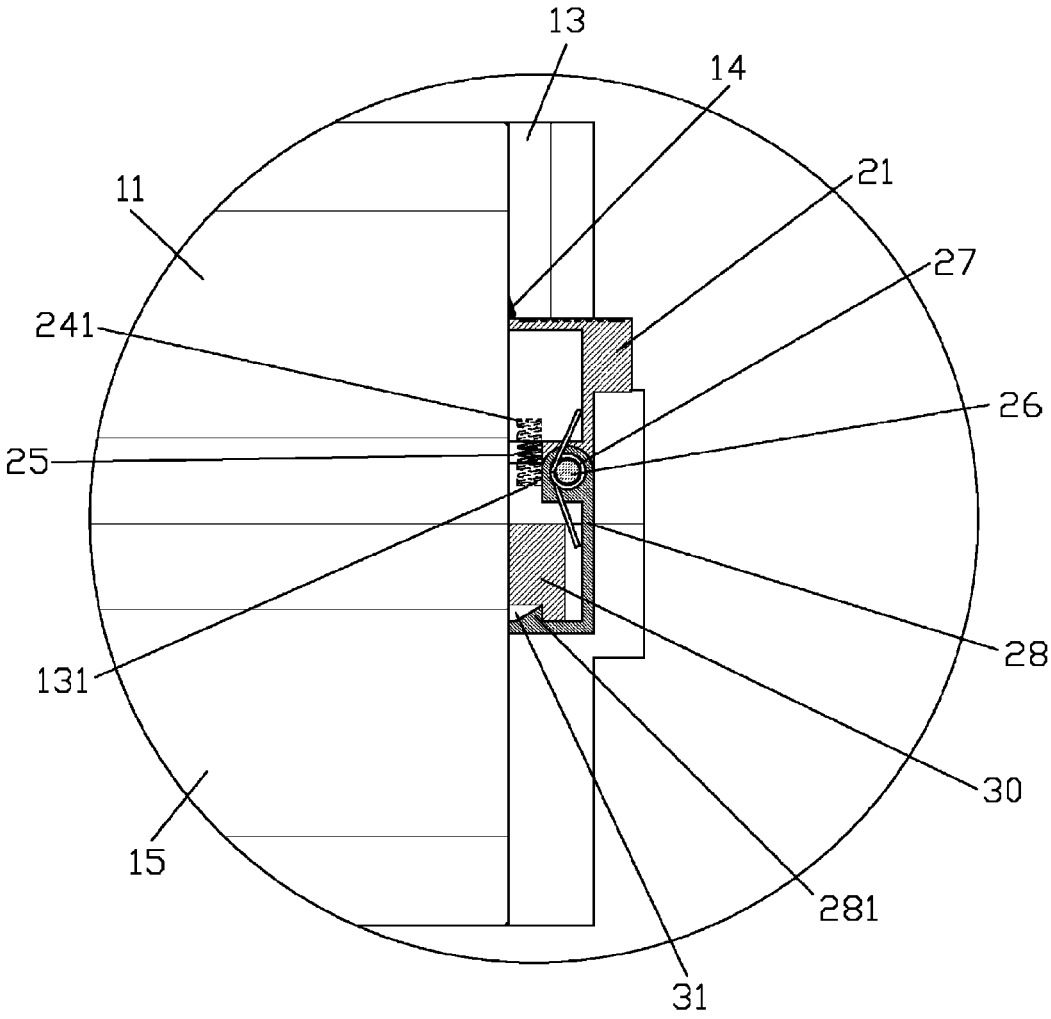
FIG. 4 is a cross sectional view of the operation of the locking device of the quick open structure for the tool box according to the preferred embodiment of the present invention.
Figure 5:
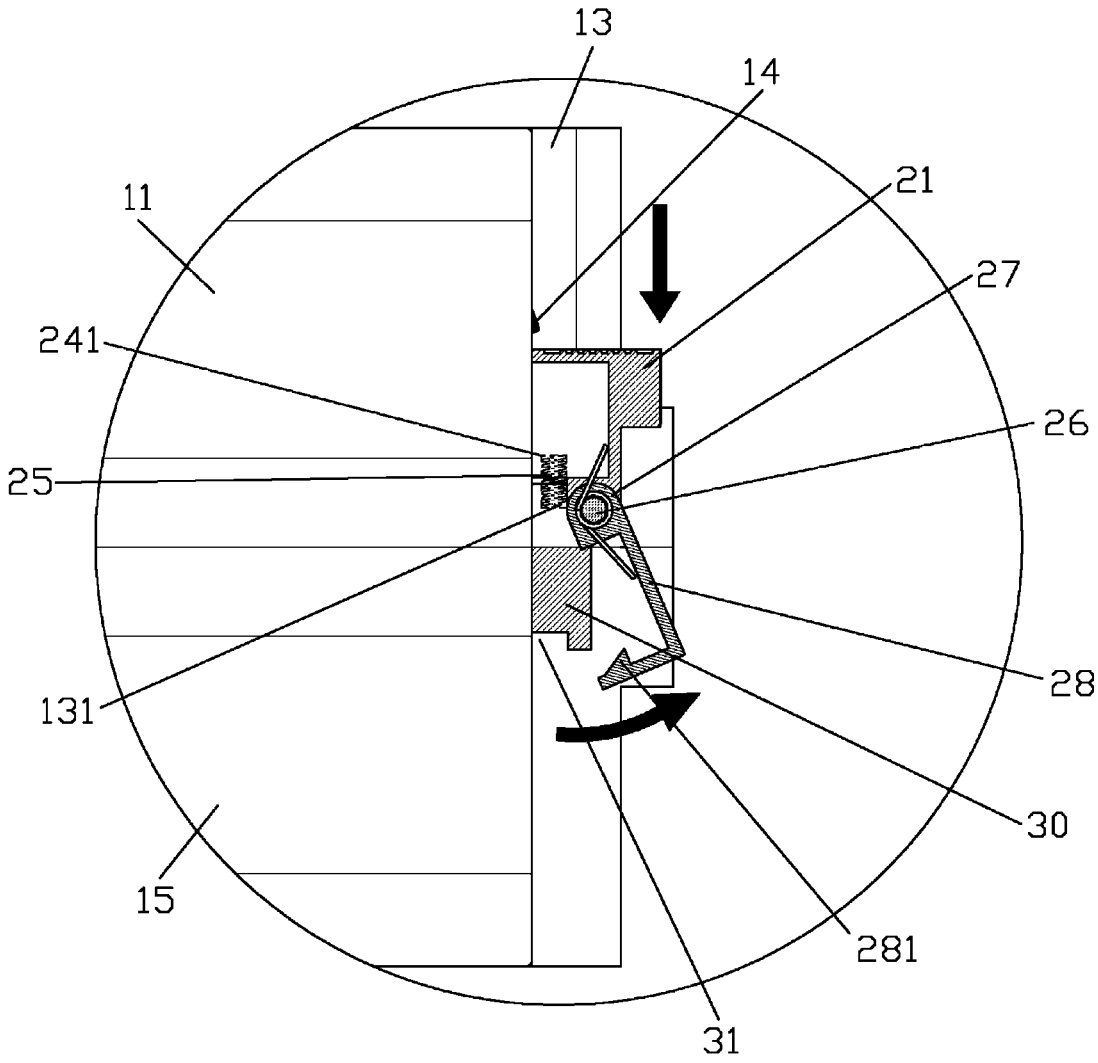
FIG. 5 is another cross sectional view of the operation of the locking device of the quick open structure for the tool box according to the preferred embodiment of the present invention.

Referring further to FIGS. 3-5, the groove 13 of the first chamber 12 also includes an opening 131 arranged on a rear end thereof to connect with the returning spring 25, and the resilient element 27 of the shaft 26 of the locking device 201 is biased against inner surfaces of the pressing member 21 and the engaging member 28 so that when the locking device 201 is fixed in the first chamber 12, the pressing member 21 is pressed and returns back to the groove 13 so as to be further limited by the limiting element 14, and when the engaging member 28 engages with the receiving member 30 of the lower housing 15, a fastening block 281 of the engaging member 28 is retained in a notch 31 of the receiving member 30 so that the upper and the lower housings 11, 15 are coupled together; after the upper and the lower housings 11, 15 are coupled together and the pressing member 21 is pressed, the engaging member 28 is actuated to move downward so that the fastening block 281 disengages from the notch 31 of the receiving member 30, and the engaging member 28 bounces outward by using the resilient element 27, thereby releasing an engagement of the body quickly.

Figure 6:
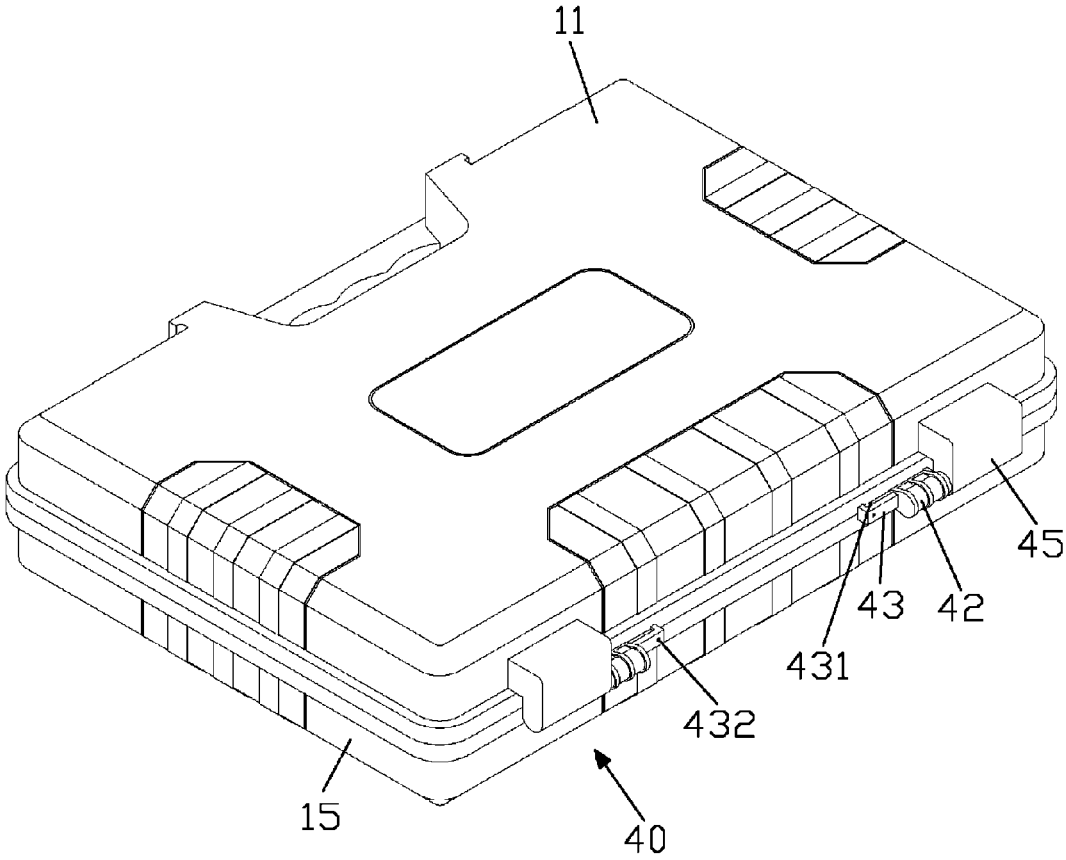
FIG. 6 is another perspective view of the assembly of the quick open structure for the tool box according to the preferred embodiment of the present invention.
Figure 7:
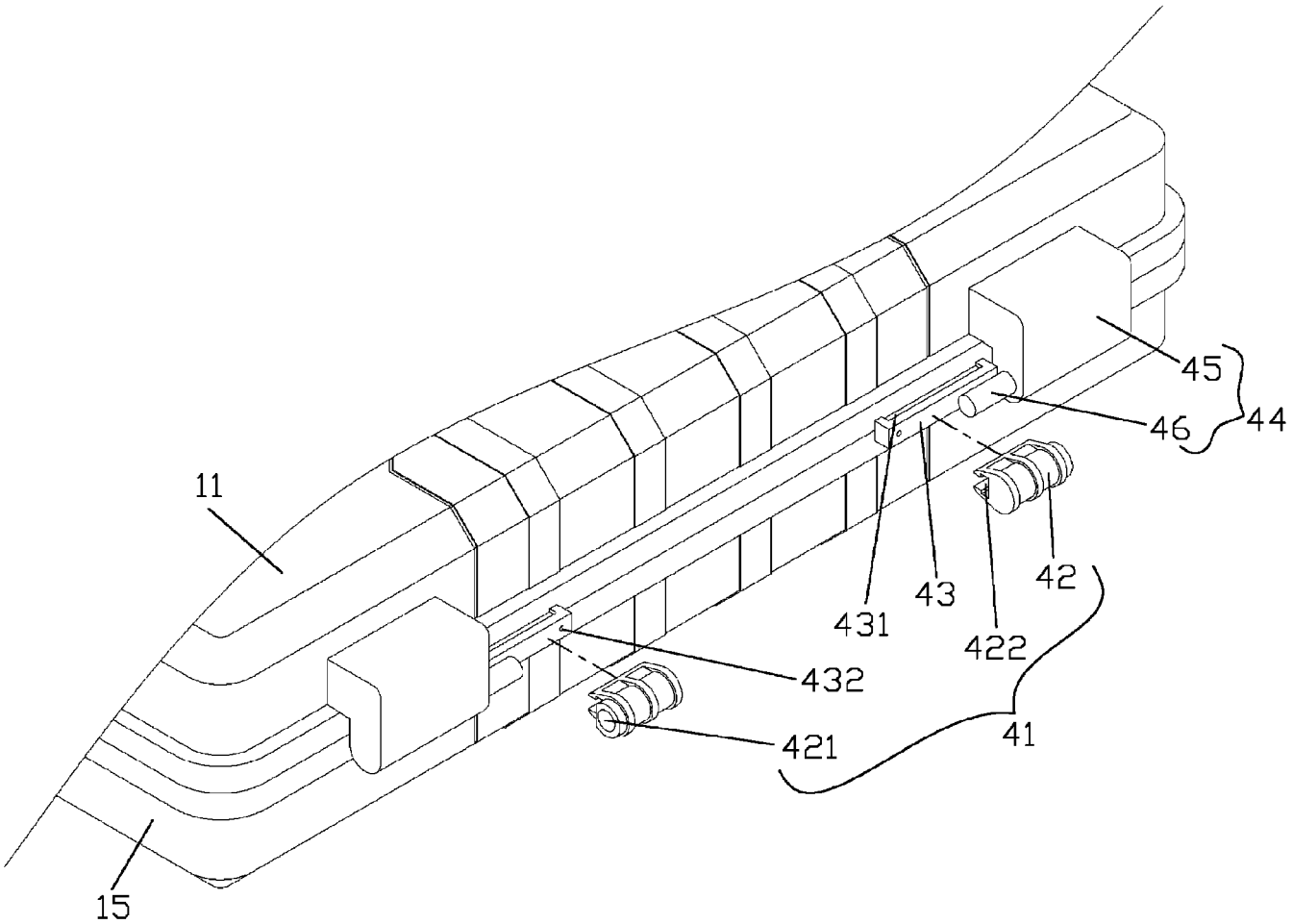
FIG. 7 is a perspective view of the exploded components of a bearing portion of the quick open structure for the tool box according to the preferred embodiment of the present invention.
Figure 8:
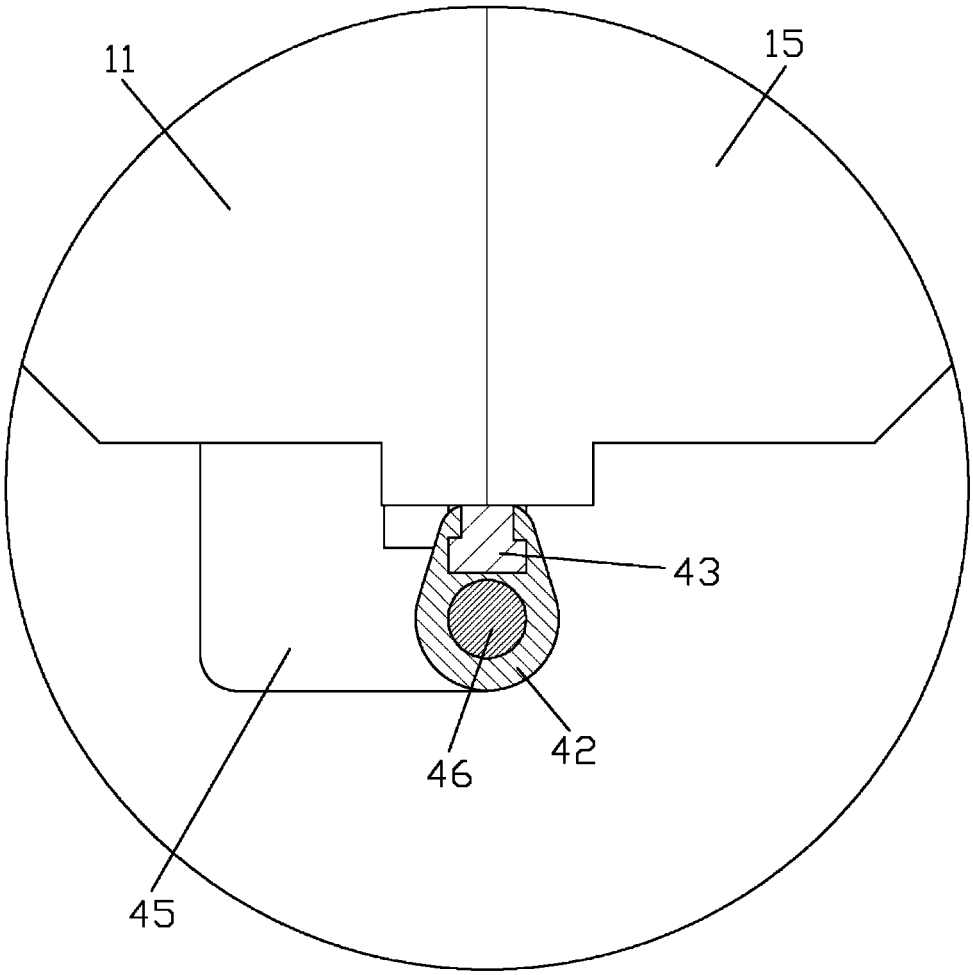
FIG. 8 is a cross sectional view of the assembly of a sliding device of the quick open structure for the tool box according to the preferred embodiment of the present invention.
Figure 9:
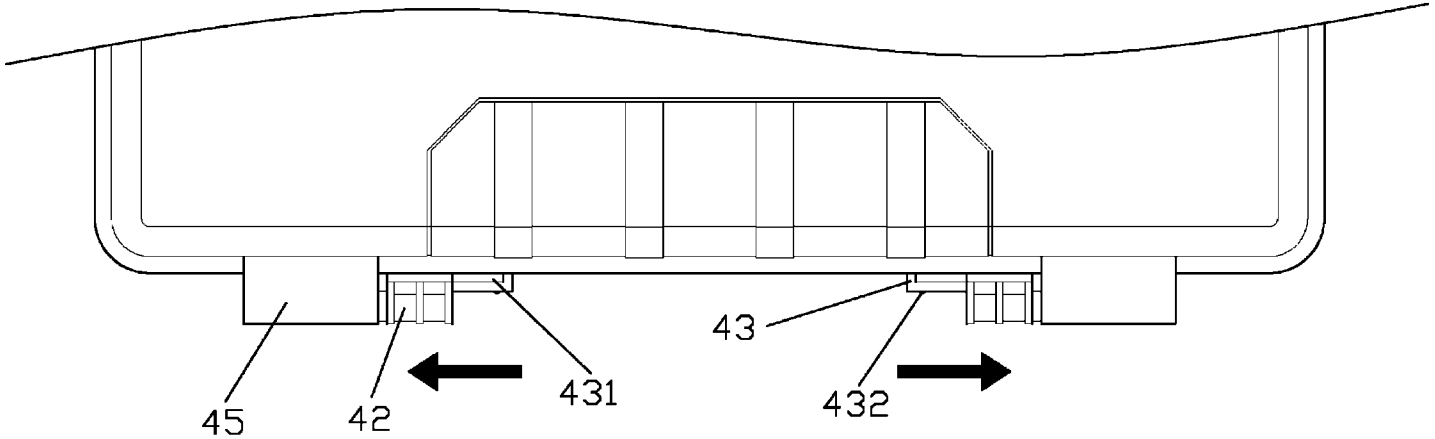
FIG. 9 is a plan cross sectional view of the operation of the bearing portion of the quick open structure for the tool box according to the preferred embodiment of the present invention.
Figure 10:
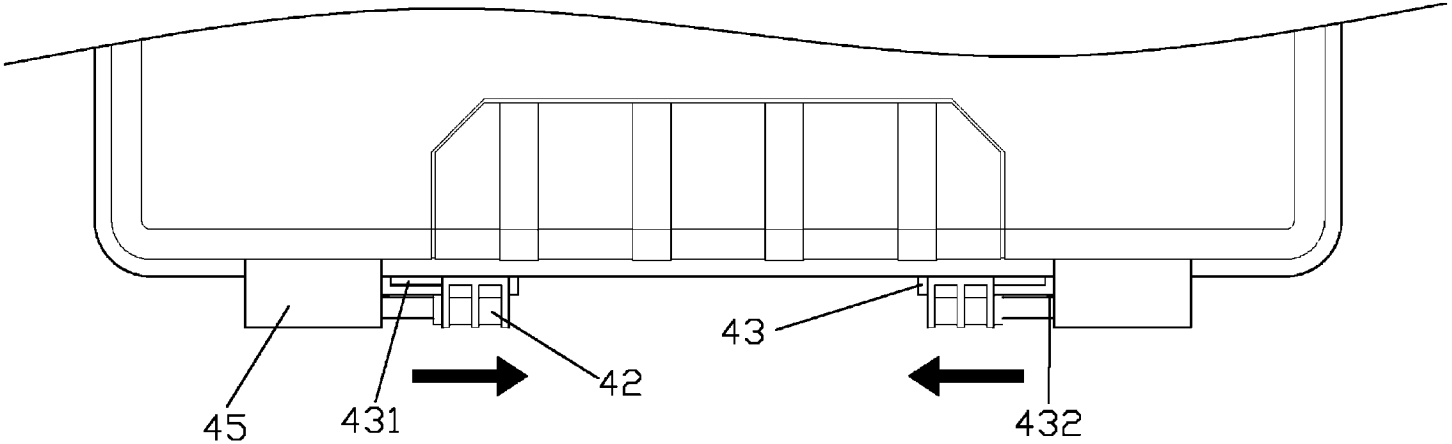
FIG. 10 is another plan cross sectional view of the operation of the bearing portion of the quick open structure for the tool box according to the preferred embodiment of the present invention.

As shown in FIGS. 6-8, two bearing portions 40 are secured on two sides of a bottom end of the body 10, and each bearing portion 40 includes a sliding deice 41 of the lower housing 15 and a bearing device 44 of the upper housing 11; wherein the sliding device 41 includes a slide rail 43, and the slide rail 43 includes two recesses 431 disposed on an upper end and a lower end thereof and two bosses 432 fixed on an inner side and an outer sides thereof, a sliding block 42 is retained in the two recesses 431 of the slide rail 43 by using a recessed portion 422 thereof to move forward and backward on the slide rail 43, and the sliding block 42 is fixed by ways of the two bosses 432 of the slide rail 43 and includes a cutout 421 formed on an outer side thereof; the sliding block 42 includes a seat 45, and the seat 45 includes a bearing 46 extending outward from an inner side thereof and located in the cutout 421 of the sliding block 42.

Figure 11:
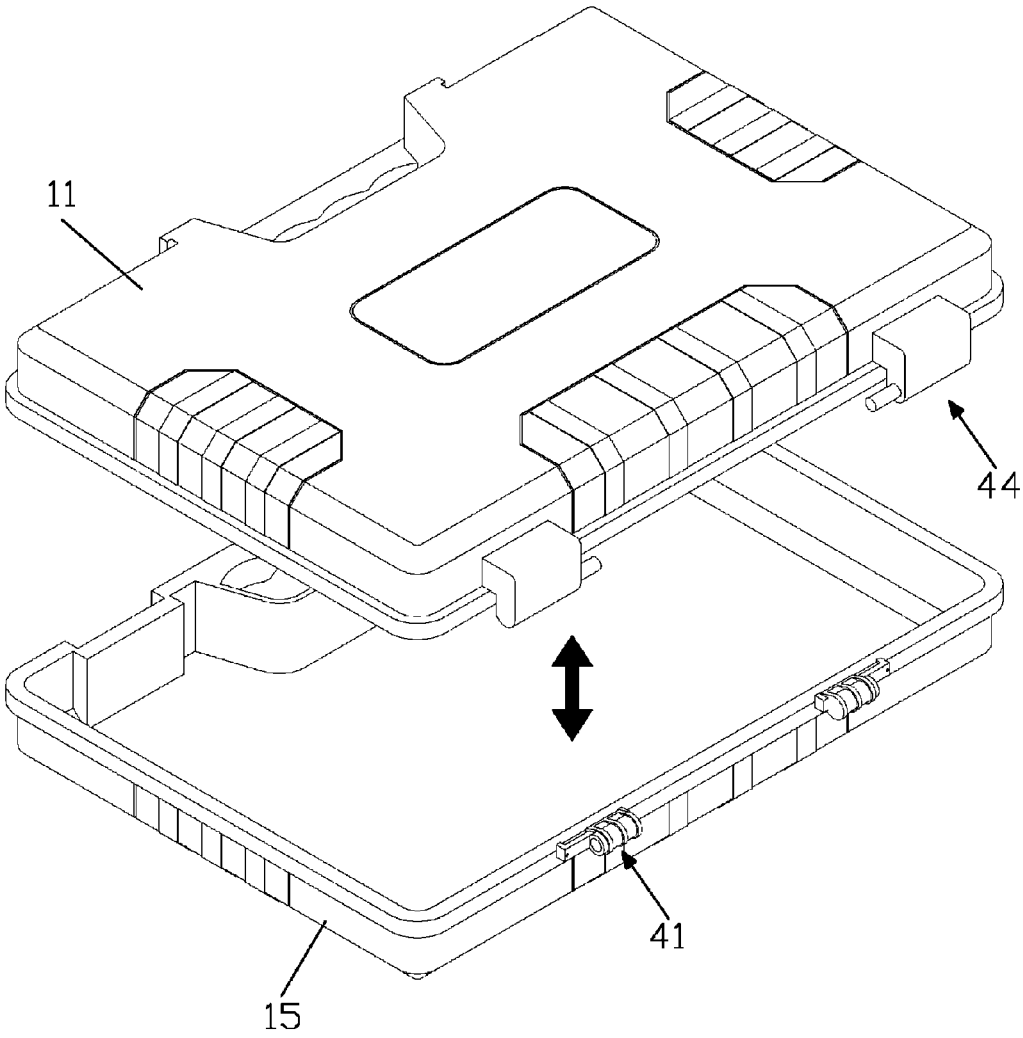
FIG. 11 is a perspective view of the operation of the quick open structure for the tool box according to the preferred embodiment of the present invention.

As illustrated in *Figs*. 9 and 10, when the sliding blocks 42 of the 1ower housing 15 move outward, the cutouts 421 of the sliding blocks 42 are fitted onto the bearings 46 of the upper housing 11 so that the bearing portions 40 are connected together, thereafter the upper and the lower housings 11, 15 are capable of being opened and closed rotatably along the bearings 46. While the sliding blocks 42 of the lower housing 45 move inward, the cutouts 421 of the sliding blocks 42 disengage from the bearings 46 of the upper housing 11 so that the bearing portions 40 leave away from each other as shown in FIG. 11, hence the upper and the lower housings 11, 15 are removed separately based on requirement.

Figure 12:
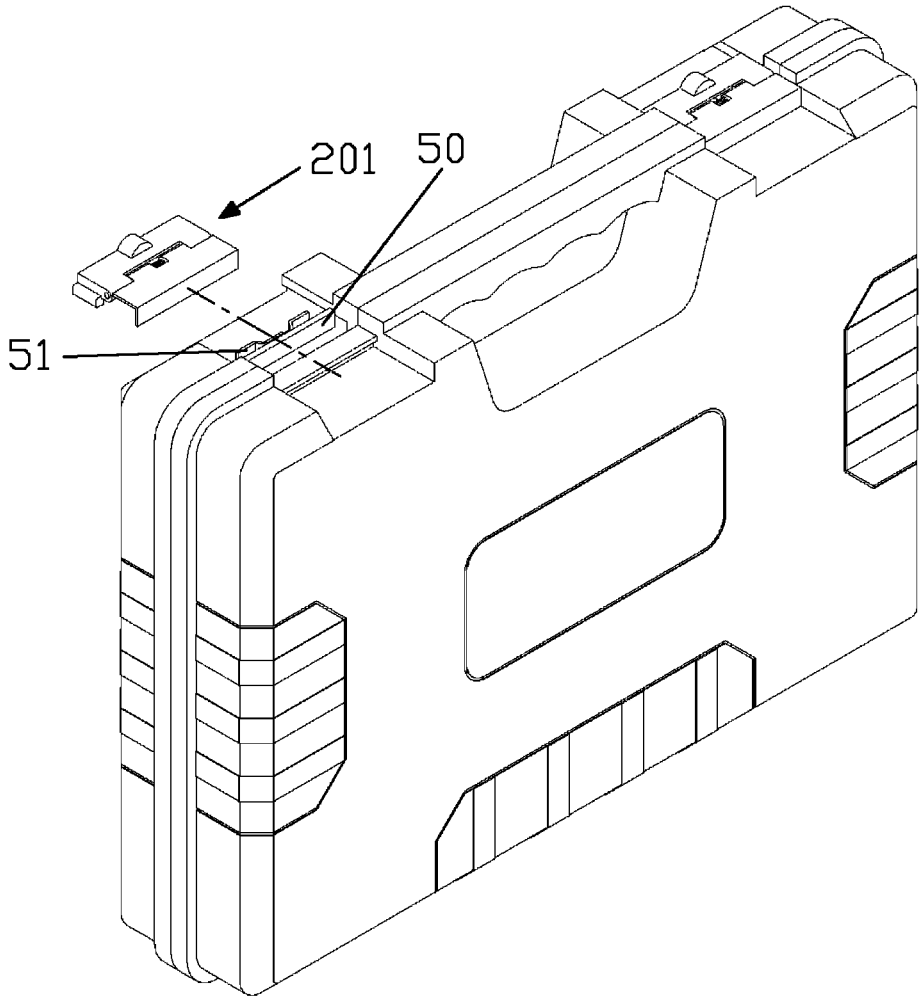
FIG. 12 is a perspective view of the operation of the locking device of the quick open structure for the tool box according to another preferred embodiment of the present invention.
Figure 13:
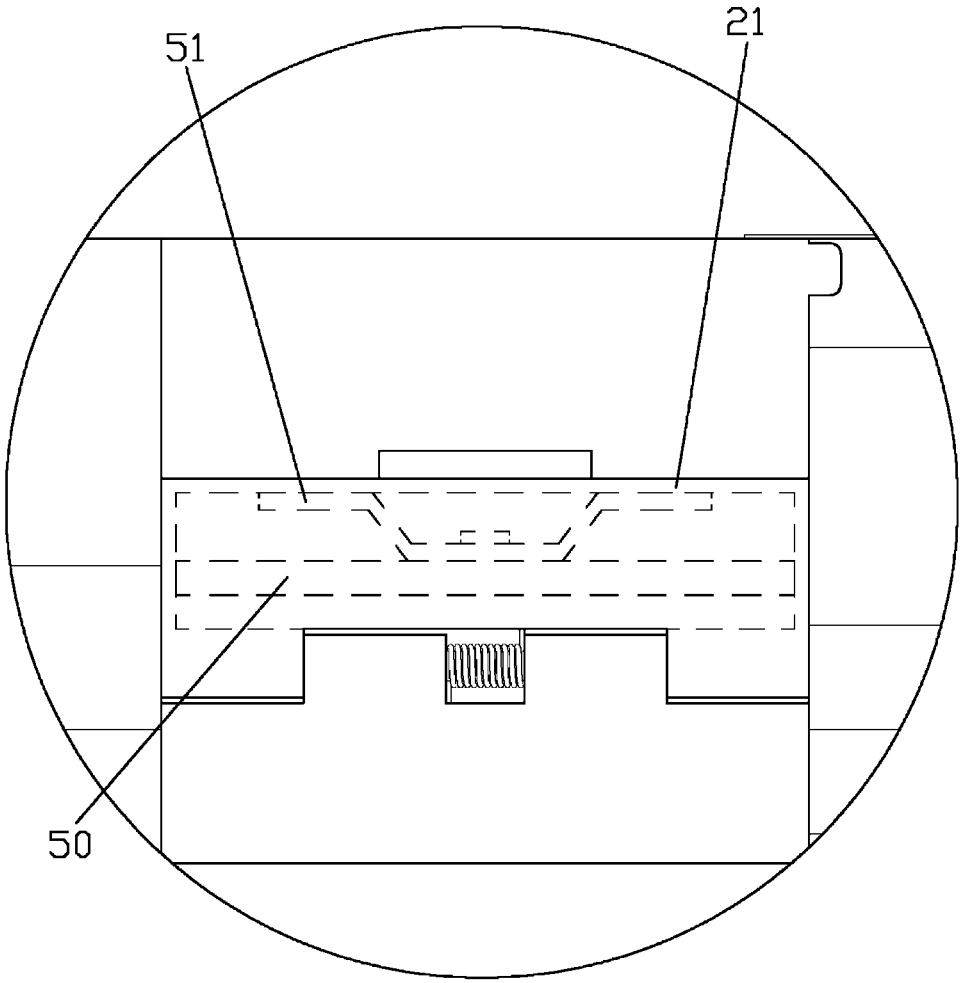
FIG. 13 is a cross sectional view of the operation of the locking device of the quick open structure for the tool box according to another preferred embodiment of the present invention.

With reference to FIGS. 12, 13, a returning structure of the locking device 201 as pressing the first chamber 12 is capable of being replaced by a holder 50 fixed in the first chamber 12, wherein the holder 50 includes an elastic element 51 secured on one side thereof in response to the pressing member 21 so that when the pressing member 21 is pressed, the elastic element 51 abuts against the inner surface of the pressing member 21 to obtain a returning function.

While we have shown and described various embodiments in accordance with the present invention, it is clear to those skilled in the art that further embodiments may be made without departing from the scope of the present invention.

What is claimed is:

1. A quick open structure for a tool box comprising:

a body including an upper housing and a lower housing, the body also including at least one retaining portions disposed on two sides of an upper end thereof, and two bearing portions secured on two sides of a bottom end thereof;

the upper housing includes at least one first chamber defined on two sides thereof, and the lower housing includes at least one second chamber defined on two sides thereof, each of the at least one first chamber including two grooves secured on two sides thereof and a limiting element extending therefrom, and each groove including an opening arranged on a rear end thereof, each of the at least one second chamber of the lower housing including a receiving member formed thereon;

wherein each of the at least one first chamber of the upper housing is provided to receive a locking device which includes a pressing member and an engaging member, and the pressing member includes a larger-area press portion formed on a front end thereof and two side straps corresponding to the two grooves, and each side strap includes a hole to receive a returning spring, and the pressing member also includes two first axial rotating portions mounted on two sides of a rear end thereof, each first axial rotating portion includes a first orifice defined therein, and the engaging member includes two second axial rotating portions disposed on a rear end thereof, and each second axial portion includes a second orifice defined therein, such that a shaft is inserted into two first orifices of the two first axial rotating portions of the pressing member and two second orifices of the second axial rotating portions of the engaging member so that the pressing member and the engaging member are connected together, and the shaft includes a resilient element fixed thereon to be biased against inner surfaces of the pressing member and the engaging member, the engaging member includes a fastening block arranged on an inner surface of a front end thereof.

2. The quick open structure for the tool box as claimed in claim 1, wherein when the engaging member engages with the receiving member of the lower housing, the fastening block of the engaging member is retained in a notch of the receiving member.

3. The quick open structure for the tool box as claimed in claim 1, wherein each groove of the at least one first chamber also includes the opening arranged on a rear end thereof to connect with the returning spring.

4. The quick open structure for the tool box as claimed in claim 1, wherein the pressing member is pressed and returns back to the groove so as to be further limited by the limiting element.

5. The quick open structure for the tool box as claimed in claim 1, wherein the at least one first chamber includes a holder fixed therein, and the holder includes an elastic element secured on one side thereof corresponding to the pressing member so that when the pressing member is pressed, the elastic element abuts against the inner surface of the pressing member.

* * * * *